US011933143B1

(12) United States Patent
Aros

(10) Patent No.: US 11,933,143 B1
(45) Date of Patent: Mar. 19, 2024

(54) PRESSURIZED FLUID FLOW SYSTEM FOR PERCUSSIVE MECHANISMS

(71) Applicant: Jaime Andres Aros, Santiago (CL)

(72) Inventor: Jaime Andres Aros, Santiago (CL)

( * ) Notice: Subject to any disclaimer, the term of this patent is extended or adjusted under 35 U.S.C. 154(b) by 0 days.

(21) Appl. No.: 17/992,011

(22) Filed: Nov. 22, 2022

(51) Int. Cl.
*E21B 4/14* (2006.01)
*E21B 1/24* (2006.01)
*E21B 10/38* (2006.01)

(52) U.S. Cl.
CPC ..... *E21B 4/14* (2013.01); *E21B 1/24* (2020.05); *E21B 10/38* (2013.01)

(58) Field of Classification Search
CPC ..... E21B 4/14; E21B 1/24; E21B 6/00; E21B 1/00; E21B 1/26; E21B 10/38; B25D 9/12
See application file for complete search history.

(56) References Cited

U.S. PATENT DOCUMENTS 2,823,013 A * 2/1958 Stenuick ..... E21B 6/00 173/104
3,169,584 A * 2/1965 Stenuick ..... E21B 4/14 173/18
3,768,576 A * 10/1973 Martini ..... E21B 7/24 173/136
4,084,646 A * 4/1978 Kurt ..... E21B 4/14 173/137
5,085,284 A * 2/1992 Fu ..... E21B 4/14 173/78
5,301,761 A * 4/1994 Fu ..... E21B 4/14 175/296
6,464,023 B2 * 10/2002 Patterson ..... E21B 7/068 175/93
8,006,776 B1 * 8/2011 Polsky ..... E21B 4/14 173/15
8,640,794 B2 * 2/2014 Aros ..... E21B 10/38 175/417
8,793,681 B2 * 7/2014 Ayachitula ..... G06F 8/65 717/171
9,016,403 B2 * 4/2015 Aros ..... E21B 4/14 175/296
10,316,586 B1 * 6/2019 Aros ..... E21B 4/14
11,686,517 B2 * 6/2023 McDonough ..... F24F 3/06 62/115

* cited by examiner

*Primary Examiner* — Yong-Suk (Philip) Ro

(57) ABSTRACT

A pressurized fluid flow system for percussive mechanisms comprises a cylinder coaxially disposed in between an outer casing and a piston which reciprocates due to the changes in pressure of the pressurized fluid contained inside a front chamber and rear chamber located at opposites sides of the piston. The discharge of fluid from these chambers being conducted through a set of discharge channels and the supply of fluid to the front chamber being conducted through a set of supply channels and a front set of recesses. The supply of fluid to the rear chamber being conducted through a piloted valve.

11 Claims, 7 Drawing Sheets

PRESSURIZED FLUID FLOW SYSTEM FOR PERCUSSIVE MECHANISMS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "SEQUENCE LISTING"

Not applicable

BACKGROUND OF THE INVENTION

Field of Application of the Invention

The present invention relates generally to pressurized fluid flow systems for percussive mechanisms operating with said fluid, particularly for percussive drilling tools and more particularly for DTH (Down-The-Hole) hammers, and to DTH hammers with said systems.

State of the Art

DTH Hammers

A numerous variety of percussive drilling mechanisms exist which use a pressurized fluid as the means for transmitting power. Among these mechanisms are down the hole (DTH) hammers which are widely used in the drilling industry, in mining as well as civil works and the construction of water, oil and geothermal wells. The DTH hammer, of cylindrical shape, is used assembling it on a drill rig located at ground surface. The drill rig also comprises a drill string comprising rods assembled together, the rear end, understood as the end that is farther to the hammer, being assembled to a rotation and thrust head and the front end, understood as the end that is closer to the hammer, coupled to it. Through this drill string the drill rig supplies the necessary pressurized fluid to the hammer for the hammer to operate.

Parts of the DTH Hammer

The main movable part of the hammer is the piston. This member of the hammer has an overall cylindrical shape and is coaxially and slidably disposed in the inside of a cylindrical outer casing. When the hammer is operative in the mode known as "drilling mode", the piston effects a reciprocating movement due to the change in pressure of the pressurized fluid contained in two main chambers, a front chamber and a rear chamber, formed inside the hammer and located at opposite ends of the piston. The piston has a front end in contact with the front chamber and a rear end in contact with the rear chamber and has outer sliding surfaces or sliding sections of the outer surface of the piston (as opposed to sections with recess areas, grooves or bores) and inner sliding surfaces or sliding sections of the inner surface of the piston, again as opposed to sections with recess areas, grooves or bores. The outer sliding surfaces are mainly designed for ensuring guidance and alignment of the piston within the hammer. Besides, in most hammers these surfaces, together with the inner sliding surfaces of the piston, in cooperation with other elements as described further along in these specifications, permit control of the alternate supply and discharge of pressurized fluid into and from the front and rear chambers.

The frontmost part of the hammer, which performs the drilling function, is known as the drill bit and it is slidably disposed on a driver sub mounted in the front end of the outer casing, the drill bit being in contact with the front chamber and adapted to receive the impact of the front end of the piston.

In order to ensure the correct alignment of the drill bit with respect to the outer casing, a component known as drill bit guide is commonly used, which is disposed in the inside of the outer casing. The rotating movement provided by the drill rig is transmitted to the drill bit by means of fluted surfaces or splines in both the rearmost part of the drill bit, or shank, and the driver sub. In turn the drill bit head, of larger diameter than the outer casing and than the drill bit shank and driver sub, has mounted therein the cutting elements that fulfill the drilling task and extend forward from the drill bit front face. The movement of the drill bit is limited in its rearward stroke by the driver sub and in its frontward stroke by a retaining element especially provided for said purpose. At the rear end of the hammer a rear sub is provided that connects the hammer with the drill string and ultimately to the source of pressurized fluid.

In the above description and that one hereinafter provided, the rear end of the hammer is understood to be the end where the rear sub is located and the front end of the hammer, the end where the drill bit is located.

Operation of the Hammer

When the hammer operates in the so called "drilling mode", which is explained further along, the front and rear chambers undergo the following states:

a—supply of pressurized fluid, wherein the fluid coming from the source of pressurized fluid is free to flow into the chamber;

b—expansion or compression, depending on the direction of the piston's movement, wherein the chamber is tightly sealed and the volume it encloses increases or decreases;

c—discharge of pressurized fluid, wherein the fluid coming from the chamber is free to flow towards the bottom of the hole; this discharge flow enables flushing of the rock cuttings generated by the drill bit, dragged in suspension in the pressurized fluid flow, towards the ground surface (process known as flushing of the hole).

In accordance with the piston's reciprocating movement, starting from the position in which the piston is in contact with the drill bit and the latter is disposed at the rearmost point of its stroke, position known as impact position, and ending in the same position with the impact of the piston over the drill bit, the respective sequences for the states of the front and rear chambers are the following: [a-b(expansion)-c-b(compression)-a] and [c-b(compression)-a-b(expansion)-c], respectively. The transition from one state to the other is independent for each chamber and is controlled totally or partially by the position of the piston with respect to other parts of the hammer in such a way that the piston acts in itself as a valve, as well as an impact element.

In a first operative mode or "drilling mode", when pressurized fluid is supplied to the hammer and the hammer is in the impact position, the piston immediately begins the reciprocating movement and the drill bit is impacted at the end of each cycle by the piston, the front end of the drill bit thereby performing the function of drilling the rock at each impact. The rock cuttings are exhausted to the ground surface by the pressurized fluid discharged from the front and rear chambers to the bottom of the hole. As the depth of the hole increases, the magnitude of the pressurized fluid column with rock cuttings also increases, producing a greater resistance to the pressurized fluid discharge from the chambers. This phenomenon negatively affects the drilling process. In some applications, the injection of fluids into the pressurized fluid flow or the leakage of water or other fluids into the hole increases even more this resistance, and the operation of the hammer may cease.

In some hammers, this operative mode of the hammer can be complemented with an assisted flushing system which allows the discharge of part of the flow of pressurized fluid available from the source of pressurized fluid directly to the bottom of the hole without passing through the hammer cycle. The assisted flushing system allows the hole to be cleaned thoroughly while it is being drilled. The pressurized fluid coming from the assisted flushing system has an energy level substantially similar to that of the pressurized fluid coming out from the source of pressurized fluid, as opposed to what happens with the pressurized fluid exhausted from the chambers, which is at a pressure substantially lower due to the exchange of energy with the piston.

In a second operative mode of the hammer or "flushing mode", the drill string and the hammer are lifted by the drill rig in such a way that the drill bit loses contact with the rock and all the pressurized fluid is discharged through the hammer directly to the bottom of the hole for cleaning purposes without going through the hammer cycle, thus ceasing the reciprocating movement of the piston.

Industrial Applications

These drilling tools are used in two fields of industrial application:

1) Production, where a kind of hammer known as "direct circulation hammer" is used, wherein the rock cuttings produced during the drilling operation are flushed to the ground surface through the annular space defined by the wall of the hole and the outer surface of the hammer and the drill string, producing wear on the outer surfaces of the hammer and the drill string by the action of said cuttings. The pressurized fluid coming from the hammer is discharged through a central passage inside the drill bit which extends from its rear end to its front end. This passage may be divided into two or more passages ending at the front face of the drill bit in such a way that the discharge of the pressurized fluid is mainly generated from the center and across the front face of the drill bit towards the peripheral region of the same and towards the wall of the hole, and then towards the ground surface along the annular space between the hammer and the wall of the hole and between the drill string and the wall of the hole. The rock cuttings are exhausted by drag and are suspended in the pressurized fluid discharged to the bottom of the hole.

Direct circulation hammers are used in mining in underground and surface developments. Due to their ability to drill medium to hard rocks, the use of this type of hammers has also extended to the construction of oil, water and geothermal wells. In general, the soil or rock removed is not used as it is not of interest and suffers from contamination on its path to the surface.

2) Exploration, where a kind of hammer known as "reverse circulation hammer" is used, which allows the rock cuttings from the bottom of the hole to be recovered at the ground surface by means of the pressurized fluid discharged to the bottom of the hole. The pressurized fluid coming from the hammer is discharged along the peripheral region of the front end of the drill bit, therefore producing a pressurized fluid flow across the front face of the drill bit towards the inside of a continuous central passage formed along the center of the hammer, typically through an inner tube known as sampling tube extending from the drill bit to the rear sub, and through the double walled rods that conform the drill string. This central passage begins in the inside of the drill bit at a point where two or more recovery passageways originated at the front face of the drill bit converge. The rock cuttings are dragged towards the central passage by the action of the pressurized fluid, said rock cuttings being recovered at the ground surface. The pressurized fluid flow with suspended rock cuttings produce wear on the inner surfaces of all the elements that form said central passage.

Either, the drill bit or a cylindrical sealing element of the hammer which has a diameter substantially similar to the diameter of the drill bit head and larger than the external diameter of the outer casing, performs the function of preventing the leakage of pressurized fluid and rock cuttings into the annular space between the hammer and the wall of the hole and between the drill string and the wall of the hole when the hole is being drilled, as happens with a direct circulation hammer, forcing these cuttings to travel through the sampling tube and drill string to the ground surface by the action of the pressurized fluid. If the drill bit performs this sealing function, it has a peripheral region that isolates the front face of the drill bit from said annular space.

The use of this type of drilling tools allows for the recovery of most of the rock cuttings, which do not suffer from contamination during their travel to the ground surface and are stored for further analysis.

Performance Variables

From the user's point of view, the variables used to evaluate the performance and usefulness of the hammer are the rate of penetration, durability of the hammer, consumption of pressurized fluid, deep drilling capacity, reliability of the hammer and rock cuttings recovery efficiency (only for reverse circulation hammers). All these factors have direct incidence in the operational cost for the user. In general, a faster and reliable hammer having a useful life within acceptable limits will always be preferred for any type of application.

Pressurized Fluid Flow Systems

Different pressurized fluid flow systems are used in hammers for the process of supplying the front chamber and the rear chamber with pressurized fluid and for discharging the pressurized fluid from these chambers. In all of them usually there is a single supply chamber formed inside the hammer from which the pressurized fluid is conveyed to the front chamber or to the rear chamber.

In most of those pressurized fluid flow systems the supply and discharge process are geometrically determined and depend on the position of the piston. In these cases, the piston acts as a valve, in such a manner that depending on its position is the state in which the front and rear chambers are, these states being those previously indicated: supply, expansion-compression and discharge.

At all times the net force exerted on the piston is the result of the pressure that exists in the front chamber, the area of the piston in contact with said chamber (or front thrust area of the piston), the pressure that exists in the rear chamber, the area of the piston in contact with said chamber (or rear thrust area of the piston), the weight of the piston and the dissipative forces that may exist (usually viscous friction). The greater the thrust areas of the piston, the greater the force generated on the piston due to a certain pressure level of the pressurized fluid, and greater the power and the energy conversion efficiency levels which can be potentially achieved. Between the front thrust area and the rear thrust area of the piston, this last one is the most important (within certain limits) because it determines almost completely, in cooperation with the pressure that exists inside the rear chamber, the piston energy at impact.

In the section "Pressurized Fluid Flow Systems" of patent U.S. Pat. No. 10,316,586 can be found a description of the prior art related to pressurized fluid flow systems (Type A to Type E Flow Systems), except for the newest Type F Flow System which is described later in this application. All of them are described with regard to the solutions for controlling the state of the front and rear chambers of a DTH hammer through the piston and its relative position with respect to other elements that are part of the hammer. The examples described refer to direct circulation hammers, but they are equally applicable to reverse circulation hammers.

Reverse circulation hammers differ from direct circulation hammers with regard to the solutions for conveying the pressurized fluid discharged from the front chamber and from the rear chamber to the bottom of the hole, specifically to the periphery of the front face of the drill bit, for flushing of rock cuttings. These exhaust Flow Systems are also, but partially, discussed in the section "Pressurized Fluid Flow Systems" of patent U.S. Pat. No. 10,316,586 (Type 1 Flow System and Type 2 Flow System). A third type, which can be identified as a Type 3 Flow System, is represented by patents U.S. Pat. No. 8,973,681 and U.S. Pat. No. 9,016,403B2.

Finally, Valve Systems (Type V1 to Type V3 Valve Systems) are discussed in this application. The "valve" is an element that can complement or even replace some of the porting functions played by one or more parts of the hammer, or some features in them, in the hammer cycles according to the descriptions in the Type A to Type F Flow Systems.

Type F Flow System, Represented by Patent U.S. Pat. No. 10,316,586 and Patent U.S. Pat. No. 11,174,679

As in the type E flow system, the designs described in these documents comprise a cylinder mounted inside the outer casing, the cylinder creating supply channels for supplying pressurized fluid to the front and rear chambers of the hammer, and discharge channels for discharging pressurized fluid from the front and rear chambers. In these designs, the supply and discharge channels are defined by respective recesses disposed in parallel longitudinally between the outer surface of the cylinder and the inner surface of the outer casing. Also, as in the type E flow system described in U.S. Pat. No. 8,640,794, these designs represent an advantage because no alignment problems must be expected since the piston only slides within the cylinder. These designs also offer a completely solid piston since the flows of pressurized fluid to and from the front and rear chambers occur externally to the piston. There are no holes or passages that weaken the piston resulting also in a simpler manufacturing process.

One important issue with the pioneering fluid flow system described in U.S. Pat. No. 10,316,586 and with the minor variation of the same described in U.S. Pat. No. 11,174,679 is that the cylinder (40) design must provide enough space for three different sets of features, being them the set of longitudinal supply channels (2), the set of longitudinal discharge channels (3) and the set of recesses (45,46) (elements (20), (28), (31) and (30,29) in U.S. Pat. No. 11,174,679 respectively) which are arranged in parallel longitudinally in the cylinder (40). This characteristic is important because it limits the maximum allowable size of the front and rear thrust areas of the piston due to the excessive thickness of the cylinder (40).

A second important issue empirically observed in the pressurized fluid flow system described in U.S. Pat. No. 10,316,586 is that there is an elastic inward deformation of the cylinder due to the permanent high pressure fluid acting on the thin bottom of the supply channels (main feed fluid passages (28) in U.S. Pat. No. 11,174,679). This inward deformation grows with the pressure of the fluid that flows through the supply channels increasing the friction between the piston (60) and the cylinder and making the design prone to fatigue failure due to galling and "piston locking" at high pressure, preventing in this way to achieve one of the key technical goals of the Type F Flow Systems, which is operate at high pressure. Two trivial solutions to this problem are to increase the clearance between the cylinder and the piston, and to make the cylinder even thicker (to increase its stiffness) at least at the longitudinal section of the cylinder where the supply channels are located. The first trivial solution is not a practical one because a large clearance between the piston and the cylinder, which is a condition found in worn hammers, results in a highly degraded general performance. The second trivial solution can be observed in the hammers depicted in patent applications number US20220065047, US20220081974 and US20220098943 (all belonging to the same inventor, see figure N°4 in all of them) which basically depict the same hammer design disclosed in U.S. Pat. No. 11,174,679 and use it as a base for explain the specific protected subject matter. This "solution" reduces even further the rear thrust area of the piston making it even smaller when compared to well-known older pressurized fluid flow systems, further disabling the piston reversibility function, which is a valuable feature for drillers to have.

In the following paragraphs different known DTH hammer valve systems are described. In this context, the "valve" element participates in and influences the process of supplying the rear chamber, and in some cases the front chamber, with pressurized fluid. The valve can also influence the process of discharging the pressurized fluid from one or both chambers. The valve systems will be described based on their functionality and based on the way they are controlled.

Type V1 Valve System, Represented by Patents U.S. Pat. No. 5,085,284, U.S. Pat. No. 5,301,761 and U.S. Pat. No. 8,631,884

The designs described in these patents use as a base a geometrically determined Type A flow system and make use of a valve slidably mounted on the rear face of the rear chamber to generate an asymmetric feeding process of the rear chamber. The valve is actuated by means of three main thrust surfaces exposed respectively to a pressure close to the one existing in the bottom of the hole, to a pressure close to the "stagnation pressure" of the flow coming from the source of pressurized fluid just after it enters the hammer and to the pressure in the rear chamber. In U.S. Pat. No. 8,631,884, the first surface is exposed to a pressure close to the one existing in the bottom of the hole when the valve is closed, but when the valve is open the pressure acting on this surface changes to a pressure somewhere in between the static pressure of the flow coming from the source of pressurized fluid and the pressure in the rear chamber.

The main problems with this type of valve system are that the pressure existing in the bottom of the hole vary drastically with the depth of the hole being drilled, causing in this way a change in the timing of the valve and so in the hammer behavior, secondly, when a thrust surface is exposed to a flow the static pressure depends on the flow velocity and can be as low as half of the "stagnation" pressure and, moreover, alignment problems, friction and rapid wear of the valve can arise due to the high number of parts involved.

Type V2 Valve System, Represented by Patents U.S. Pat. No. 2,823,013 and U.S. Pat. No. 3,169,584

The designs described in these patents use a valve to control the filling of the front and rear chambers with pressurized fluid while the discharge of both chambers only depends on the piston position relative to a cylinder or inner sleeve.

The two possible valve states are either front chamber supply open-rear chamber supply closed, or front chamber supply closed—rear chamber supply open. In the first case, the rear face of the valve is exposed to a pressure lower to the one existing in the distributor, specifically in the feeding chamber, from where pressurized fluid is directed to the front chamber (how much lower depends on the flow velocity through the rear face of the valve), and the front face of the valve is exposed to the pressure existing in the rear chamber. In the second case, the front face of the valve is exposed to a pressure close to the one existing in the distributor, from where pressurized fluid is directed to the rear chamber, and the front face of the valve is exposed to the pressure existing in the front chamber.

The pressures needed in the rear and front chambers to respectively move the valve to its upper and lower positions are achieved by means of quasi-adiabatic compression processes in the respective chambers. In the "mode of operation" described in U.S. Pat. No. 2,823,013, when the ram (piston) is moving upward, it is possible to see that the rear chamber starts the compression process from a pressure equal or close to the bottom hole pressure. The first main issue with this approach is that the bottom hole pressure changes and increases with the depth of the well being drilled, which implies that the hammer behavior as a whole, and particularly the valve behavior, changes during the deepening of the hole. The second issue is that the rear chamber feeding starting-finishing points are not independent of the front chamber feeding starting-finishing points which results in a too short frontward acceleration stroke or in an excessive deacceleration stroke due to a long feeding process of the front chamber during the frontward stroke. The third issue is that the pressure existing on the rear face of the valve is not the one existing in the front chamber, but the static pressure of the flow stablished between the distributor and the front chamber which in turns depends on the flow velocity and as explained before, can be as low as half of the "stagnation" pressure of the flow entering the hammer. Finally, because the front chamber feeding starting-finishing points are controlled at the valve level, all the feeding passages need to be filled with pressurized fluid retarding the filling of the front chamber with pressurized fluid and increasing in this way the passive volume and air consumption.

Type V3 Valve System, Represented by Patent U.S. Pat. No. 8,006,776

The design described in this patent uses as a base a geometrically determined Type B flow system and make use of a ported valve slidably mounted externally to the pressurized fluid supply tube and inside the piston to control the filling of the rear chamber and the filling of the front chamber with pressurized fluid. The purpose of this valve system is to take advantage of the well-known benefits of an asymmetric timing that looks for an extended pressurization of the rear (or power) chamber and a reduced pressurization of the front (or return) chamber of the hammer during the frontward stroke.

The main problem with this design is that all the "biasing devices" envisioned fall into the spring kind. These types of devices have two disadvantages, they are prone to failure due to fatigue which can be exacerbated by corrosion induced by the presence of brine water in the pressurized fluid flow and the force-displacement characteristic behavior is dependent on the compression of the "spring kind" biasing device.

A valuable explanation about asymmetric timing advantages can be found in the section "DETAILED DESCRIPTION OF THE INVENTION" of U.S. Pat. No. 8,006,776.

OBJECTIVES OF THE INVENTION

According with the issues and technical antecedents stated, it is a goal of the present invention to present a new pressurized fluid flow system that, when used in percussive mechanisms and particularly in DTH hammers, provides a better general performance than the percussive mechanisms and DTH hammers of the previous art, particularly the ones based on the Type F Flow System. Specifically, and without sacrificing its useful life, it is a goal of the present invention to provide a percussive mechanism with the following advantages:

a higher power and a higher efficiency in the energy conversion process, which implies a higher penetration rate.

a structurally simple design and reduced manufacturing cost.

a higher reliability and sturdiness.

It is also an objective of the invention to achieve these advantages with the use of a valve system for feeding the rear chamber as this makes it possible to have a cylinder design that is much thinner and eliminates the unwanted effects of the cylinder's inward deformation, allowing a completely reversible piston design with a higher rear thrust area and a much tighter clearance with respect to the cylinder. Moreover, the valve system makes it possible to provide an asymmetric feeding process of the rear chamber which has the following advantages:

An increase in the hammer's power as a result of an extended acceleration phase during the frontward stroke, which is achieved by means of keeping pressurized fluid flowing into the rear chamber beyond the point where the valve opens in the rearward stroke; and An increase in the hammer's efficiency (the power to pressurized fluid flow consumption ratio).

Specifically, the use of this valve system will contribute to obtain the desired higher power and/or higher efficiency in the energy conversion process, which implies a higher penetration rate. All of this without sacrificing the hammer's useful life or decrease its reliability and sturdiness. A thorough discussion of the advantages of asymmetric timing (or asymmetric porting) can be found in the section "DETAILED DESCRIPTION OF THE INVENTION" in document U.S. Pat. No. 8,006,776.

BRIEF SUMMARY OF THE INVENTION

With the purpose of providing an improved pressurized fluid flow system for percussive mechanisms (particularly DTH hammers) according to the above defined goals, a solution has been devised that makes a more efficient use of the cross-sectional area of the hammer when compared to the previous art (especially the one based on the Type F Flow System) which allows an improved performance and extended useful life.

The pressurized fluid flow system of the invention is characterized by having a piston comprising a set of outer sliding surfaces of equal diameter thus avoiding failure of this part due to thermal cracks induced by friction between the piston and misaligned parts (air guide, supply tube, foot valve, etc.). Moreover, the piston does not have any bores, channels or passages, making it a completely solid component.

The pressurized fluid flow system of the invention is further characterized by having a cylinder coaxially disposed in between the outer casing and the piston; and two sets of channels: one set of supply channels and one set of discharge channels, delimited by the outer surface of the cylinder and the inner surface of the outer casing. The set of supply channels is permanently filled with fluid coming from the source of pressurized fluid and connected without interruption to the outlet of said source. The set of discharge channels is permanently communicated with the outside of the percussive mechanism. The supply channels are disposed in parallel longitudinally with respect to the discharge channels.

The piston has a recess on its external surface that defines, in cooperation with the inner surface of the cylinder, a supply chamber. The supply chamber is permanently connected without interruption to the set of supply channels. In this way, the supply chamber is permanently filled with fluid coming from the source of pressurized fluid and connected without interruption to the outlet of said source through the set of supply channels.

The flow of pressurized fluid discharged from the front and rear chambers is solely controlled by the overlap or relative position of the outer sliding surfaces of the piston with respect to the inner surface of the cylinder. Multiple discharge through-ports are provided in the cylinder for channeling the pressurized fluid from the front and rear chambers to the set of discharge channels.

A front set of recesses is provided in the cylinder for channeling the pressurized fluid from the supply chamber to the front chamber. These recesses are longitudinally aligned with the supply channels.

The pressurized fluid flow system of the invention is also characterized by having a valve located rear of the rear chamber. This valve has three main surfaces:

- a rear surface being totally or partially exposed, depending on if the valve is respectively in its closed or open position, to the pressure inside a pressurized volume. This pressurized volume being in permanent fluid communication with a set of sensing channels formed in between the outer surface of the cylinder and the inner surface of the outer casing. The sensing channels being aligned longitudinally with one or more of the channels of the set of discharge channels and intermittently connected with the rear chamber.
- a rear surface being exposed permanently to the pressure of the flow coming from the source of pressurized fluid.
- a front surface being partially or totally exposed, depending on if the valve is respectively in its closed or open position, to the rear chamber pressure. The supply of pressurized fluid to the rear chamber occurs when the valve is in its open position.

The above-mentioned configuration allows the flows of pressurized fluid into and out of the front and rear chambers to take place outside the piston and enables a better use of the cross-sectional area of the percussive mechanism (or down-the-hole hammer) compared to the prior art. By arranging the set of supply channels and front set of recesses in parallel longitudinally with the set of sensing channels and discharge channels it is possible to make the cylinder thinner and thus increase the front and rear thrust areas of the piston.

For a better understanding of the precedent ideas, the invention is hereinafter described with reference to the accompanying drawings.

Figure 1:
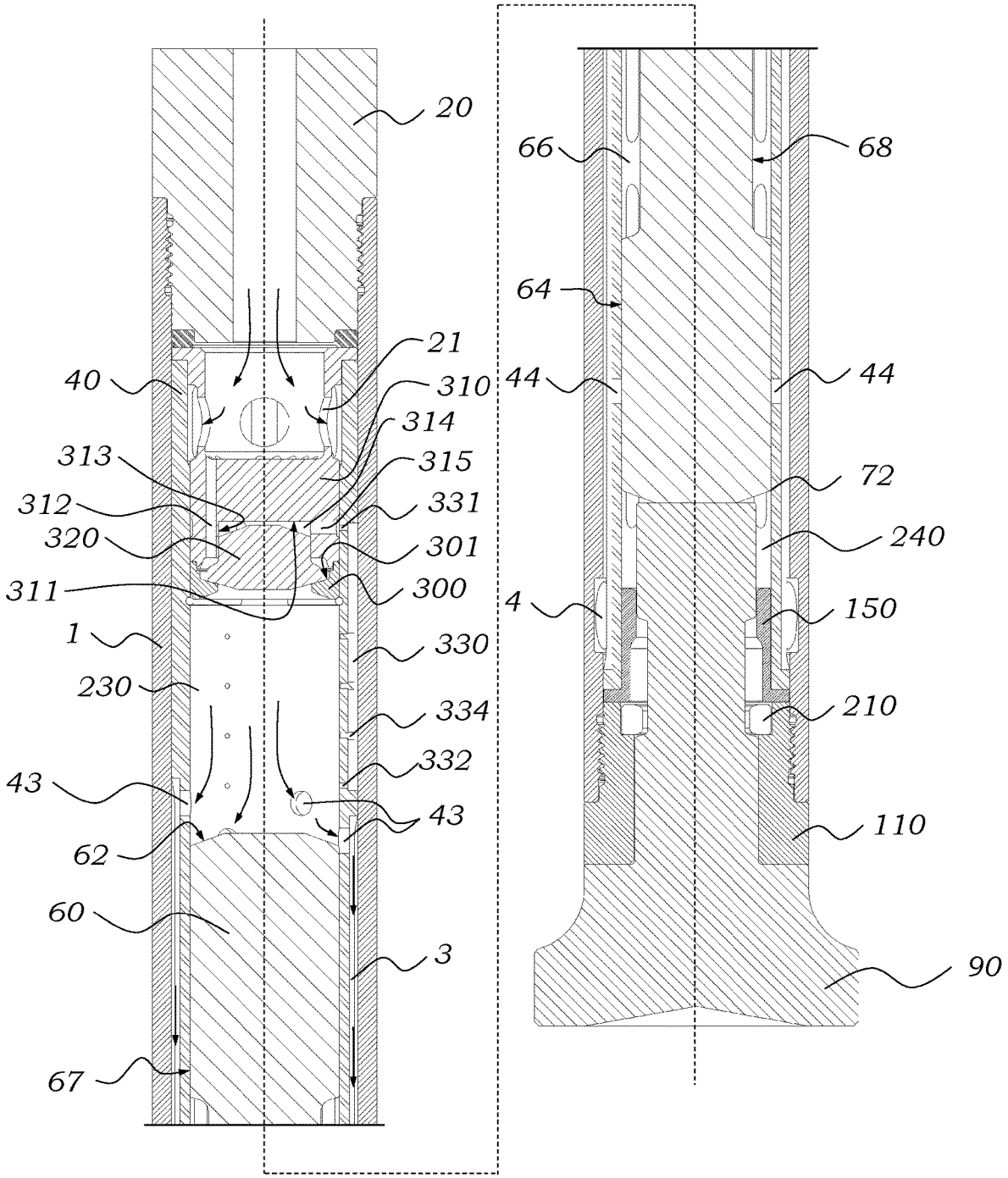
FIG. 1 depicts a longitudinal cross section view of the pressurized fluid flow system of the invention, specifically showing the disposition of the piston with respect to the outer casing, cylinder, valve and drill bit when the rear chamber is discharging pressurized fluid into the discharge channels.
Figure 2:
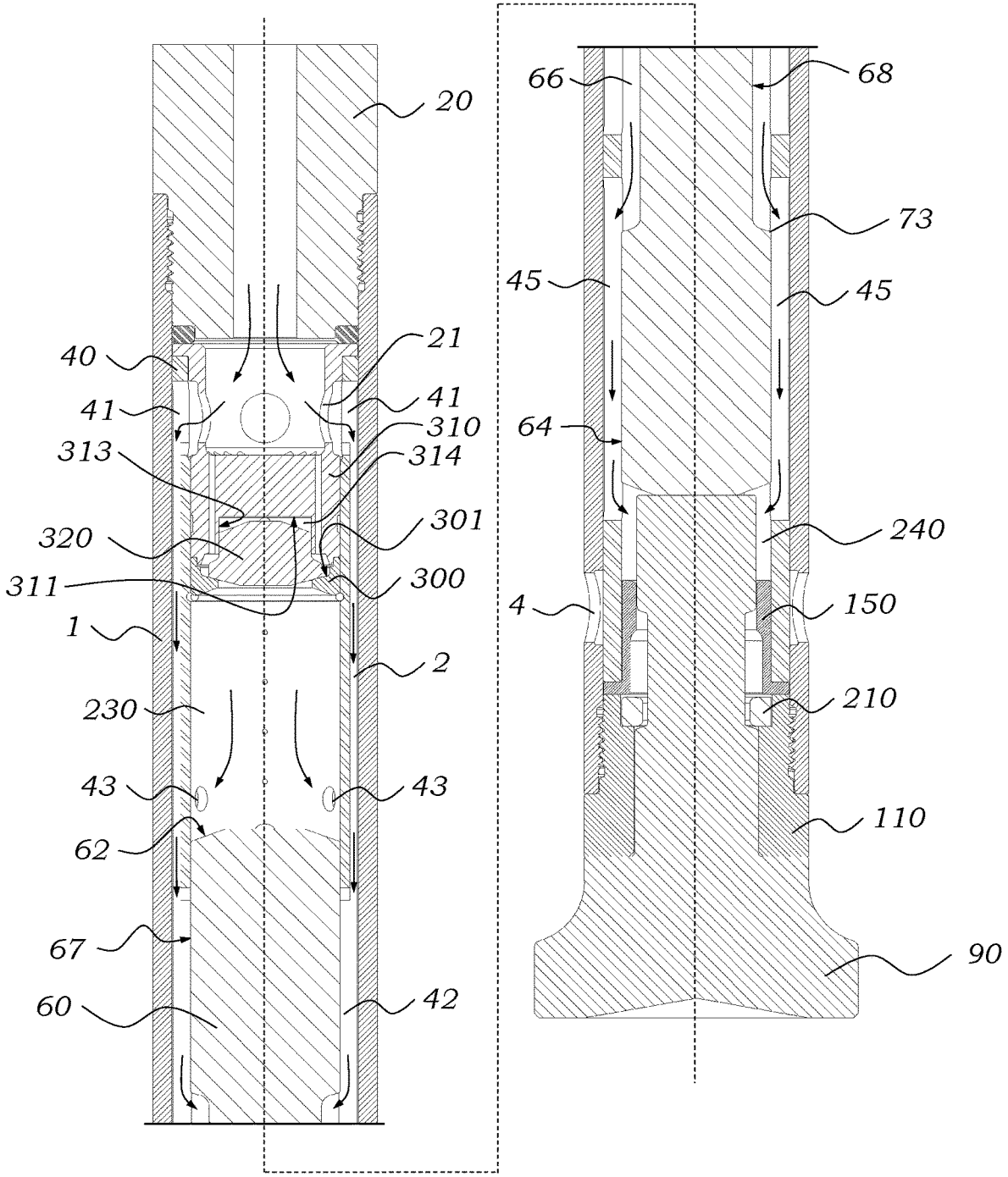
FIG. 2 depicts a second longitudinal cross section view of the pressurized fluid flow system of the invention, where this second longitudinal cross section view is perpendicular to the longitudinal cross section view shown in FIG. 1, specifically showing the disposition of the piston with respect to the outer casing, cylinder and drill bit when the front chamber is being supplied with pressurized fluid.

In graph 8A, the power of the mechanism is plotted as a function of the front chamber's maximum feeding area for several level curves where each of these curves represents a different fixed rear chamber maximum feeding area. The x-axis labels and the level curves values are parametrized as multiples of a set value "A".

In graph 8B, the efficiency of the mechanism is plotted as a function of the front chamber maximum feeding area for several level curves where each of these curves represents a different fixed rear chamber maximum feeding area. The x-axis labels and the level curves values are parametrized as multiples of a set value "A".

The maximum feeding area is defined as the minimum fixed area (as opposed to variable areas originated by the porting transitions) in the whole path traveled by the fluid from the source of pressurized fluid to the respective chamber.

FIG. 9 shows two graphs labeled A and B. These graphs represent the typical behavior of the mass flow rate into the front chamber and into the rear chamber, respectively, in one single piston's reciprocating cycle starting from the position in which the piston is in contact with the drill bit and ending in the same position.

In graph 9A, the mass flow rate into the front chamber is plotted as a function of time for three different values of the fixed rear chamber maximum feeding area: (labeled Optimum), 2A (labeled Degraded) and A (labeled Very Degraded) when the front chamber maximum feeding area is equal in value to A.

In graph 9B, the mass flow rate into the rear chamber is plotted as a function of time for three different values of the fixed rear chamber maximum feeding area: (labeled Optimum), 2A (labeled Degraded) and A (labeled Very Degraded) when the front chamber maximum feeding is equal in value to A.

Again, the maximum feeding area is defined as the minimum fixed area (as opposed to variable areas originated by the porting transitions) in the whole path traveled by the fluid from the source of pressurized fluid to the respective chamber. The values 2A and A were chosen among the values A, 2A, 3A, 5A and 10A based on the performance shown by the different level curves in graphs 8A and 8B. For example, the power and efficiency values shown by the level curves with values 5A and 10A for the fixed rear chamber maximum feeding area differ marginally. In this case the value 5A can be considered "Optimum" because a value of 10A implies increase the cylinder's sectional area and reduce, consequently, the piston's thrust areas (reducing the power and efficiency levels). The front chamber maximum feeding area was set to a value of A this value shows an optimum or close to optimum performance in graphs 8A and 8B.

DETAILED DESCRIPTION OF THE INVENTION

Referring to FIGS. 1 to 9, an exemplary embodiment of the pressurized fluid flow system for percussive mechanisms according to the invention is shown that comprises the following main components:

a cylindrical outer casing (1) having a rear end and a front end;

a driver sub (110) mounted to said front end of the outer casing (1);

a rear sub (20) affixed to said rear end of the outer casing (1) for connecting the mechanism to the source of pressurized fluid;

a piston (60) slidably and coaxially disposed inside said outer casing (1) and capable of reciprocating due to the changes in pressure of the pressurized fluid contained inside of a front chamber (240) and a rear chamber (230) located at opposites ends of the piston (60), the piston (60) having a rear thrust surface (62), a front thrust surface (63) and front and rear outer sliding surfaces (64, 67);

a cylinder (40) that is coaxially disposed in between the outer casing (1) and the piston (60), the cylinder (40) having an inner (47) and an outer surface (48);

a valve carrier (300) disposed rear of the rear chamber (230) and mounted on the inner surface (47) of the cylinder (40), the valve carrier (300) having a rear valve support surface (301) and the valve carrier's (300) frontmost external surface defining partially the rear limit of the rear chamber (230);

a probe carrier (310) disposed rear of the valve carrier (300), the probe carrier (310) having a front valve support surface (311), one or more longitudinal fluid passageways (312), an inner valve sliding surface (313), one or more pressure transmitting radial passageways (315) and one or more fluid supply through holes (21);

a valve (320) mounted in a space created between the valve carrier (300) and the probe carrier (310). The valve (320) able to slide longitudinally on the inner valve sliding surface (313) of the probe carrier (310) for moving between a front-located closed position and a rear-located open position. The valve (320) further having a front support surface (322), a rear support surface (323), a front thrust surface (324), a rear thrust surface (325) and a biasing thrust surface (326). The rear support surface (323) and the rear thrust surface (325) of the valve (320) creating together with the inner valve sliding surface (313) and the front valve support surface (311) of the probe carrier (310) a pressurized volume (314); and a drill bit (90) slidably mounted on the driver sub (110), wherein the sliding movement of the drill bit (90) is limited by a drill bit retainer (210) mounted on the driver sub (110);

The rear chamber (230) of the percussive mechanism is defined by the valve carrier's (300) frontmost external surface, the valve (320), the cylinder (40) and the rear thrust surface (62) of the piston (60). The volume of the rear chamber (230) is variable depending on the piston's (60) position. The front chamber (240) of the hammer is defined by the drill bit (90), the cylinder (40), a drill bit guide (150) (which is an element that can be skipped) and the front thrust surface (63) of the piston (60). The volume of the front chamber (240) is also variable and depending also on the piston's (60) position.

The piston (60) further comprises an annular recess (68) on its external surface that defines, in cooperation with the inner surface (47) of the cylinder (40), a pressurized fluid supply chamber (66). This pressurized fluid supply chamber (66) is respectively longitudinally limited at each end by the outer sliding surfaces (64, 67) of the piston (60).

The cylinder (40) has a set of longitudinal supply channels (2) and a set of longitudinal discharge channels (3) defined by respective longitudinal recesses or grooves on its outer surface (48), the longitudinal supply (2) and discharge (3) channels being disposed around said outer surface (48) for in the first case conveying pressurized fluid from the rear sub (20) to the pressurized fluid supply chamber (66) and therefrom to the front (240) chamber and in the second case discharging the pressurized fluid from the front (240) and rear (230) chambers. When the percussive mechanism is operative, the longitudinal supply channels (2) are in permanent fluid communication with the source of pressurized fluid and they are filled with said fluid while the longitudinal discharge channels (3) are in permanent fluid communication with the outside of the percussive mechanism.

The cylinder (40) further has one or more pressurized fluid intake ports (41) bored therethrough which connect the longitudinal supply channels (2) with the fluid supply through holes (21) in the probe carrier (310) and has front pressurized fluid exit ports (42) bored therethrough which fluidly and uninterruptedly communicate the set of longitudinal supply channels (2) of the cylinder with the pressurized fluid supply chamber (66), therefore permanently filling it with pressurized fluid. The cylinder (40) also has rear (43) and front (44) sets of discharge ports bored therethrough which allow the pressurized fluid to respectively flow from the rear chamber (230) and front chamber (240) into the set of longitudinal discharge channels (3).

The cylinder (40) further has a front set of recesses (45) bored therethrough in its wall for allowing the pressurized fluid which flows from the rear sub (20) to the pressurized fluid supply chamber (66), through the set of longitudinal supply channels (2), to be diverted to the front (240) chamber in cooperation with the front outer sliding surface (64) of the piston (60). The front set (45) of recesses being disposed in series longitudinally with respect to the longitudinal supply channels (2) for reducing and making an optimal use of the cylinder's (40) sectional area.

Moreover, the cylinder (40) also has a set of sensing channels (330) defined by respective longitudinal recesses on its outer surface (48), wherein the sensing channels (330) are disposed in series longitudinally with respect to the longitudinal discharge channels (3) for reducing and making an even more optimal use of the cylinder's (40) sectional area.

Figure 6:
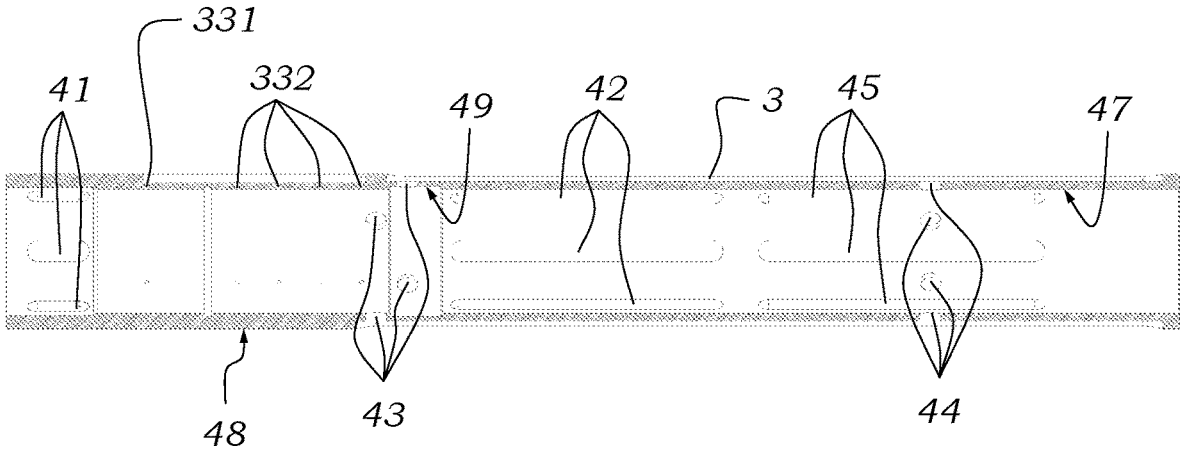
FIG. 6 depicts a cross section view of the cylinder of FIG. 4 wherein an undercut on its inner surface has been added as a buffer for the inward elastic deformation.
Figure 7:
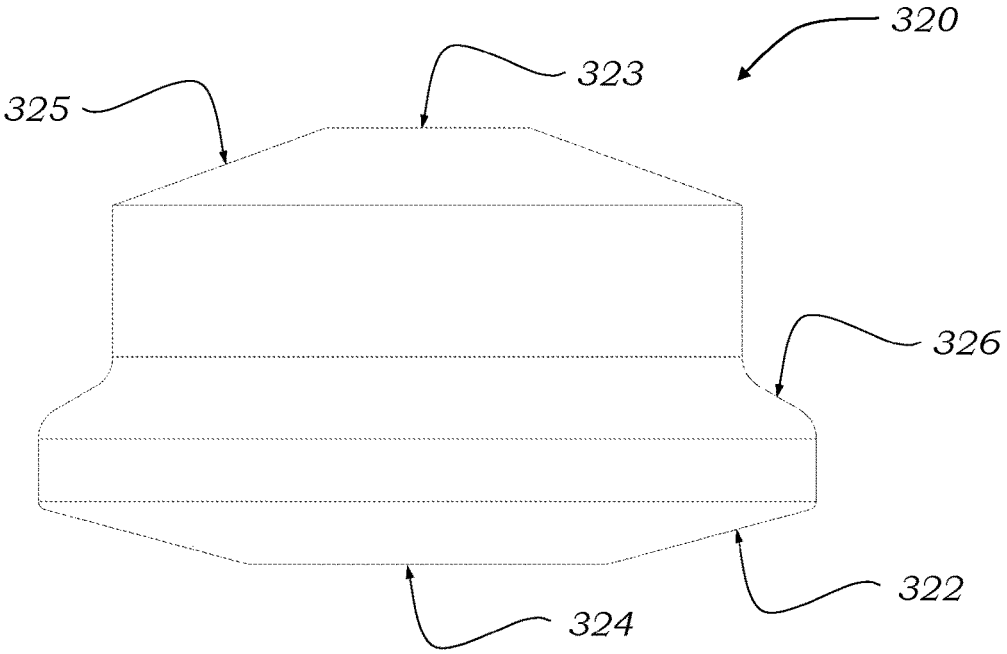
FIG. 7 depicts the valve of the pressurized fluid flow system of the invention.

In this regard, each of the sensing channels (330) has a probe carrier's (310) pressure transmitting radial passageways (315)-connecting port (331) and one or more rear chamber-connecting ports (332), see FIG. 6, where at least one of the rear chamber-connecting ports (332) is not plugged with plugs (334), to transmit the pressure inside the rear chamber (230) to the pressurized volume (314) through the pressure transmitting radial passageways (315) of the probe carrier (310) when the rear chamber-connecting ports (332) are not covered by the rear outer sliding surface (67) of the piston (60).

Control of the State of the Front Chamber (240)

When in the hammer cycle the impact face (61) of the piston (60), which is part of the front thrust surface (63), is in contact with the impact face (91) of the drill bit (90) and the drill bit (90) is at the rearmost point of its stroke, i.e. the hammer is at impact position (see FIG. 2), the front chamber (240) is in direct fluid communication with the pressurized fluid supply chamber (66) through the front set of recesses (45) of the cylinder (40). In this way, the pressurized fluid is able to freely flow from the pressurized fluid supply chamber (66) to the front chamber (240) and start the movement of the piston (60) in the rearward direction.

This flow of pressurized fluid to the front chamber (240) will stop when the piston (60) has traveled in the front end to rear end direction of its stroke until the point where the front outer supply edge (73) of piston (60) reaches the rear limit of the front set of recesses (45) of the cylinder (40). As the movement of the piston (60) continues further in the front end to rear end direction of its stroke, a point will be reached where the front outer discharge edge (72) of the piston (60) reaches the front limit of the front discharge ports (44) of the cylinder (40). As the movement of the piston (60) continues even further, the front chamber (240) of the hammer will become fluidly communicated with the set of longitudinal discharge channels (3) through the front set of discharge ports (44) of the cylinder (40) (see FIG. 3). In this way, the pressurized fluid contained inside the front chamber (240) will be discharged into the set of longitudinal discharge channels (3) and from the set of longitudinal discharge channels (3) it is able to freely flow out of the percussive mechanism.

Normally, the drill bit (90) is aligned to the outer casing (1) of the hammer by the drill bit guide (150). However, the invention is not limited to the use of a drill bit guide (150) and alternative alignment solutions may be used or skipped. Also, the final flow path from the set of longitudinal discharge channels (3) out of the mechanism will depend on the application of the percussive mechanism: pave breakers, down-the-hole hammers (normal circulation or reverse circulation), rotary percussion drilling systems, etc. In the embodiments described in FIGS. 1, 2 and 3 the flow of fluid is channeled out of the mechanism through ports (4) in the outer casing (1) as would occur in a pave breaker.

Control of the State of the Rear Chamber (230)

When in the hammer cycle the impact face (61) of the piston (60), which is part of the front thrust surface (63), is in contact with the impact face (91) of the drill bit (90) and the drill bit (90) is at the rearmost point of its stroke, i.e. the hammer is at impact position, the valve (320) is in its closed position (see FIG. 1 and FIG. 2) and the rear chamber (230) is in direct fluid communication with the set of longitudinal discharge channels (3) through the rear set of discharge ports (43) of the cylinder (40). In this way, the pressurized fluid contained inside the rear chamber (230) will be discharged into the set of longitudinal discharge channels (3) and from the set of longitudinal discharge channels (3) it is able to freely flow out of the percussive mechanism. Again, the final flow path from the set of longitudinal discharge channels (3) out of the mechanism will depend on the application of the percussive mechanism.

This flow of pressurized fluid will stop when the piston (60) has traveled in the front end to rear end direction of its stroke (see FIG. 3) until the point where the rear outer discharge edge (70) of piston (60) reaches the rear limit of the rear set of discharge ports (43) of the cylinder (40). Beyond this point, pressure will start building-up inside the rear chamber (230) due to compression in a close to isentropic like process.

Figure 3:
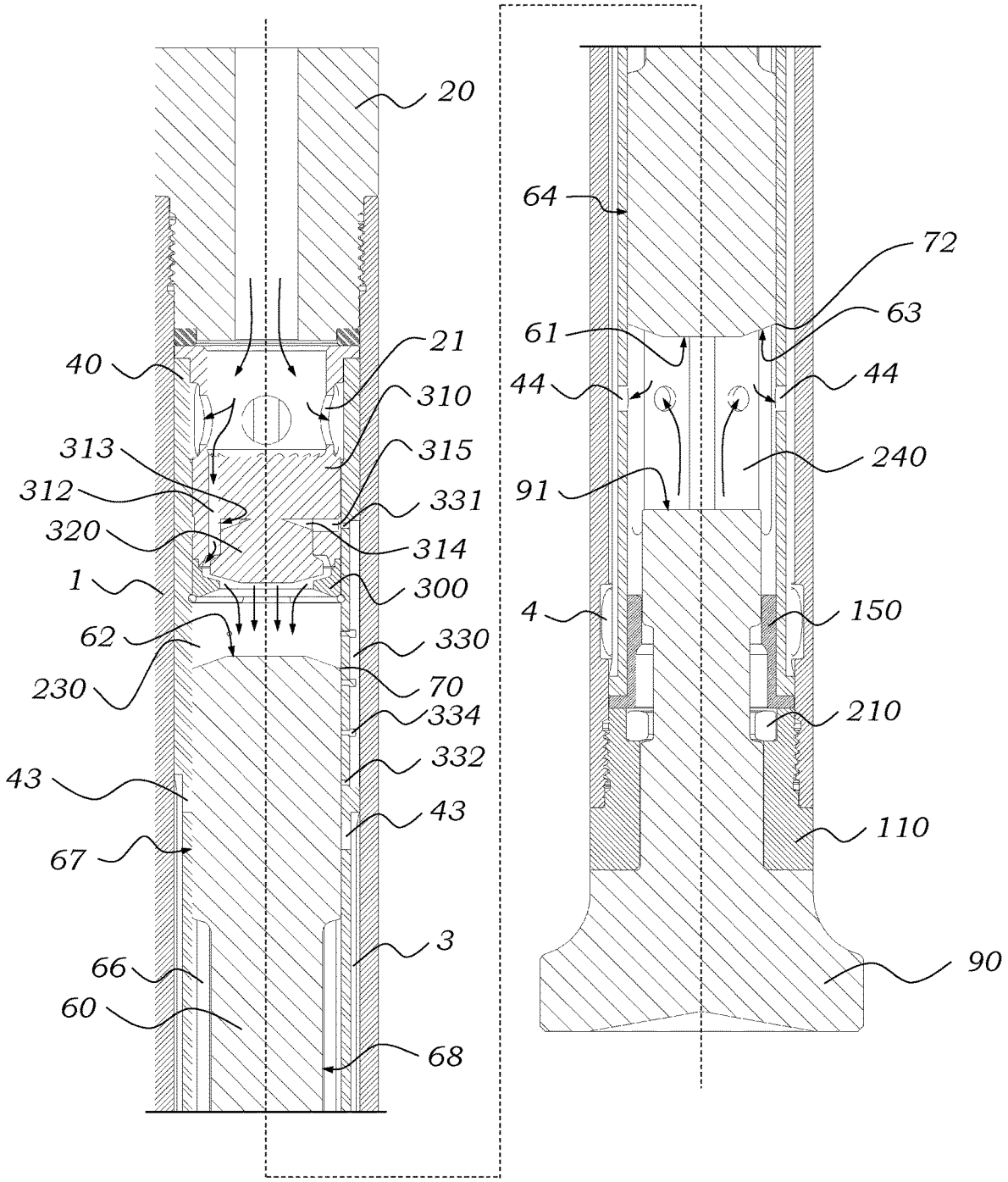
FIG. 3 depicts a longitudinal cross section view of the pressurized fluid flow system of the invention, specifically showing the disposition of the piston with respect to the outer casing, cylinder, valve and drill bit when the rear chamber is being supplied with pressurized fluid and the front chamber is discharging pressurized into the discharge channels.
Figure 4:
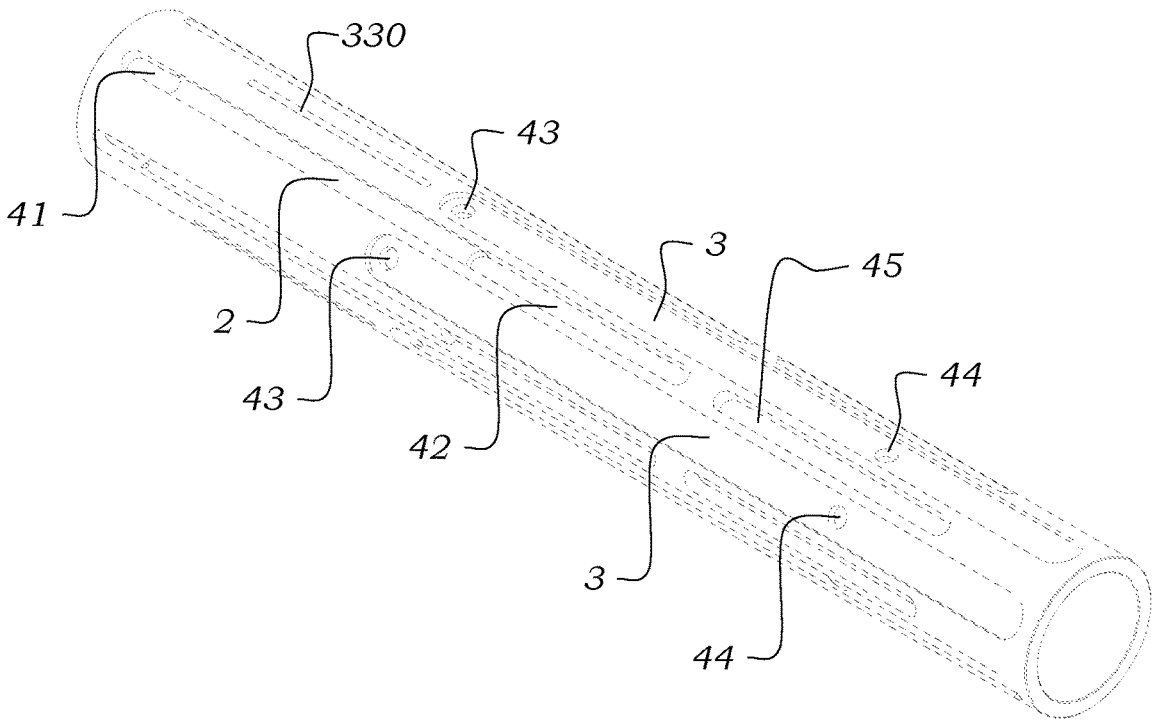
FIG. 4 depicts an isometric view of the cylinder of the pressurized fluid flow system of the invention.
Figure 5:
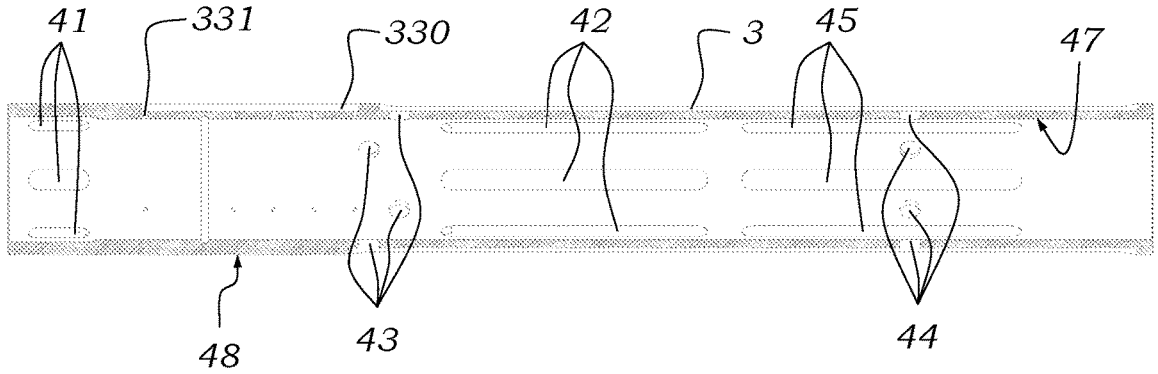
FIG. 5 depicts a cross section view of the cylinder of FIG. 4 for a best understanding of the different features of this element.

As the movement of the piston (60) continues further in the front end to rear end direction of its stroke, a point will be reached where the rear outer discharge edge (70) of the piston (60) reaches the rear limit of the rearmost ports (332) that are not plugged with plugs (334). At this point, the sensing channels (330) and the pressurized volume (314) will become isolated from the rear chamber (230) by the rear outer sliding surface (67) of the piston (60) and become pressurized at the pressure level existing in the rear chamber (230) at that point of the piston's reciprocating cycle. As the movement of the piston (60) continues even further, pressure will continue building-up inside the rear chamber (230) due to the compression process until the pressure inside the rear chamber (230) is high enough to cause the valve (320) opening (FIG. 3 shows the valve in its open position). In this way, the rear chamber (230) will be supplied with fluid coming directly from the source of pressurized fluid through the longitudinal fluid passageways (312) of the probe carrier (310).

The high pressure of the pressurized fluid acting on the rear thrust surface (62) of the piston (60) will drive it frontward. As the movement of the piston (60) continues in the rear end to front end direction of its stroke, again a point will be reached where the rear outer discharge edge (70) of piston (60) reaches the rear limit of the rearmost ports (332) that are not plugged with plugs (334). At this point, the sensing channels (330) and the pressurized volume (314) will become again in fluid communication with the rear chamber (230) and become pressurized at the higher pressure level existing in the rear chamber (230) at that point of the piston's reciprocating cycle causing the valve (320) closing due to the force acting on its rear thrust surface (325).

Valve Operation

When the valve (320) is closed (see FIG. 1 and FIG. 2, see also FIG. 7 to identify all the valve's surfaces), the pressure acting on the biasing thrust area (326) is equal to the stagnation pressure (this is a well stablished concept in thermodynamics and fluid mechanics as well) of the fluid coming from the source of pressurized fluid through the longitudinal fluid passageways (312) of the probe carrier (310). The force exerted on the biasing thrust area (326) is added to the forces exerted on the rear support surface (323) and the rear thrust surface (325) due to the pressure that exists inside the pressurized volume (314) and all these forces act in the rear end to front end direction. Simultaneously, the only forces that act in the front end to rear end direction (without considering the friction, which are negligible, and reaction forces) are the forces due to the pressure inside the rear chamber (230) acting on the front thrust surface (324) and on the partially exposed front support surface (322).

In a similar fashion, when the valve (320) is open, the pressure acting on the biasing thrust area (326) is equal to the stagnation pressure of the fluid coming from the source of pressurized fluid through the longitudinal fluid passageways (312) of the probe carrier (310). The force exerted on the biasing thrust area (326) is added to the force exerted on the rear thrust surface (325) due to the pressure that exists inside the pressurized volume (314) and both forces act in the rear end to front end direction. Simultaneously, the only forces that act in the front end to rear end direction are the forces due to the pressure inside the rear chamber (230) acting on the front thrust surface (324) and on the front support surface (322), this late being fully exposed to the rear chamber (230) when the valve (320) is open. Reaction forces should not be considered in the calculations of the valve's (320) areas (322, 323, 324, 325, 326) which ultimately determine the "close-open" and "open-close" states transitions.

In situations where increase the efficiency is also important, which means improve the percussive mechanism power to pressurized fluid consumption ratio, or the flow rate coming from the source of pressurized fluid is limited, a retarded opening of the valve (320) can be accomplished unplugging ports (332) closer to the rear end of the mechanism.

Design Considerations

The embodiment of the percussive mechanism described previously and depicted in FIGS. 1 to 7 is only one of many obvious variations that can be envisioned, including for example longitudinal passageways equivalent to the sensing channels (330) but on the inner surface (or even in the wall) of the outer casing (1). Likewise, channels (2,3) are described as "longitudinal" because the fluid flow through them is mainly longitudinal (in the mechanism axis direction), but they can have a helical shape.

Similarly, recesses (45) are showed in the embodiment as through all holes letting the inner surface of the outer casing (1) act as the sealing bottom of the channels or passages that they create. It is obvious that different approaches can be used to create these channels, including but not limited to recesses on the inner surface (47) of the cylinder (40) or recesses on the outer surface (48) of the cylinder (40) together with ports at the recesses' ends to communicate them with the cylinder's (40) inner surface (47).

In a similar fashion, the probe carrier (310) and the valve carrier (300) don't need to be separated parts and can be built in in the rear sub (20) and in the cylinder (or sleeve) respectively. These kinds of changes must be considered obvious.

It will be appreciated by those skilled in the art that other changes, besides the ones mentioned above, could be made to the embodiment described without departing from the broad inventive concept thereof. It is understood, therefore, that this invention is not limited to the embodiment disclosed, but it is intended to cover modifications within the spirit and scope of the present invention.

In the figures, the probe carrier (310) has a surficial undercut to avoid the need of angular alignment with respect to the cylinder (40). Because this is an obvious design solution, that undercut is not considered a critical feature of the invention and it is not numbered.

Figure 8A:
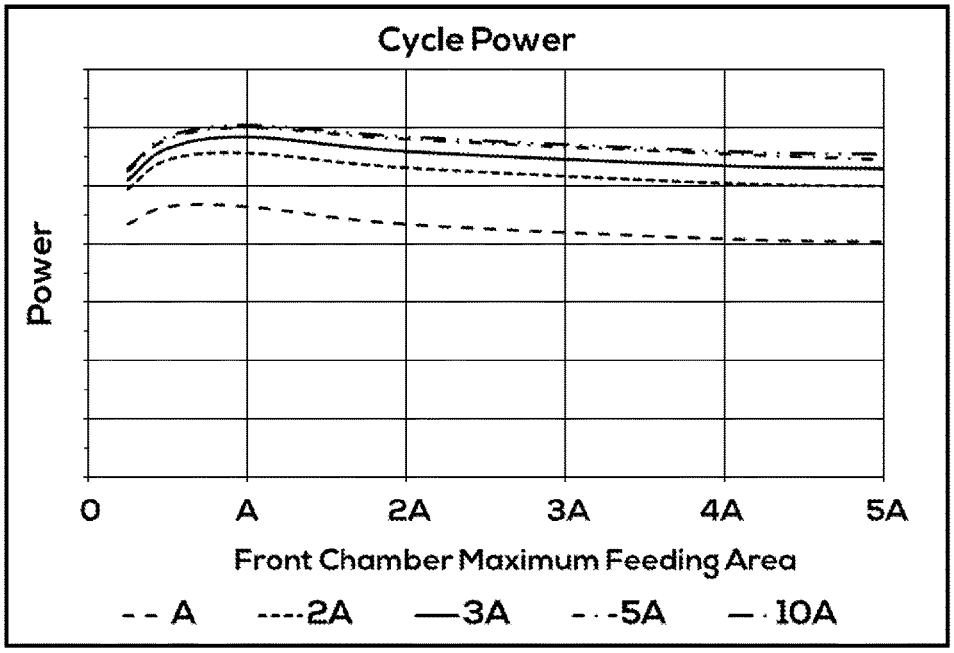
FIG. 8 shows two graphs labeled A and B. These graphs represent the typical behavior of power and efficiency (power to mass flow rate of pressurized fluid ratio) of a percussive mechanism.
Figure 8B:
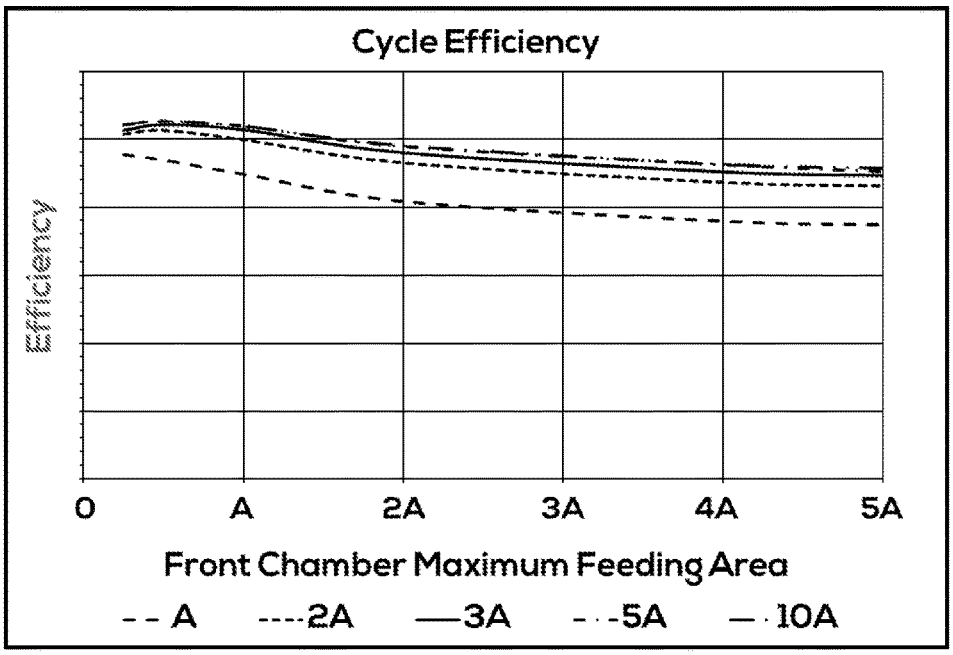

In a different matter, observing FIG. 8A and 8B, several conclusions can be drawn:

The mechanism generates maximum power at a low value of the front chamber (240) maximum feeding area (in between "½ A" and "A"). A similar behavior can be observed for efficiency.

The mechanism generates higher power for higher values of the rear chamber maximum feeding area, but the effect in power of a fixed percentual increment decreases with the base value of the rear chamber maximum feeding area. A similar behavior can be observed for efficiency.

Optimum values of power and efficiency are achieved for values of the rear chamber's (230) maximum feeding area several times higher (five to twenty) than the values of the front chamber's (240) maximum feeding area.

The last point reveals another advantage of not supply the rear chamber (230) with pressurized fluid through the cylinder (40). Because in the present invention only the front chamber (240) is supplied, through recesses (45), with pressurized fluid coming from the longitudinal supply channels (2) and the pressurized fluid supply chamber (66), making possible a design where the recesses (45) are disposed in series longitudinally with respect to the longitudinal supply channels (2), the cylinder (40) can have a very reduced sectional area because the longitudinal supply channels (2) and recesses (45) don't need to have a high sectional area, allowing it be even more compact and allowing increase the piston (60) thrust areas even further.

Figure 9A:
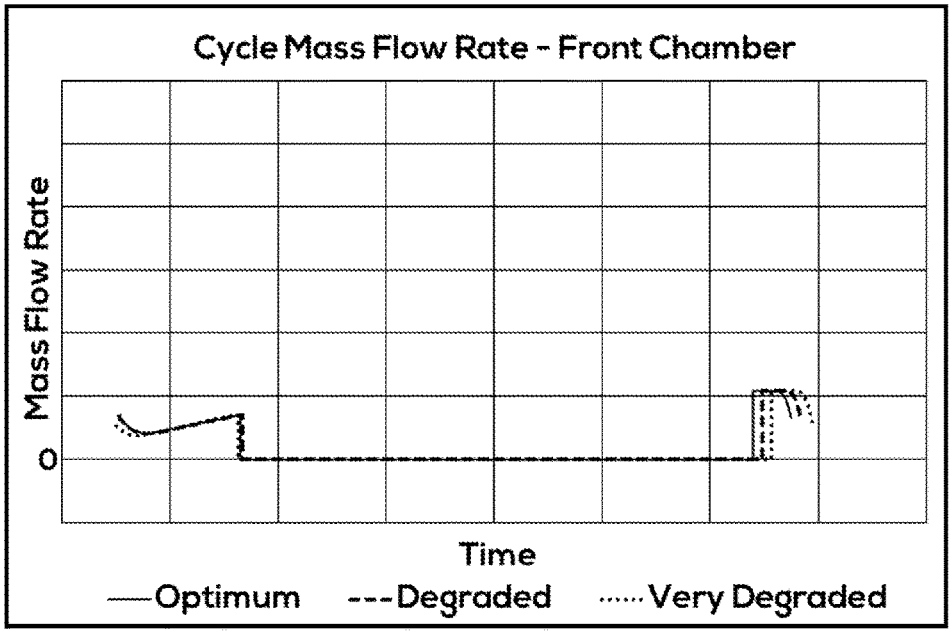
Figure 9B:
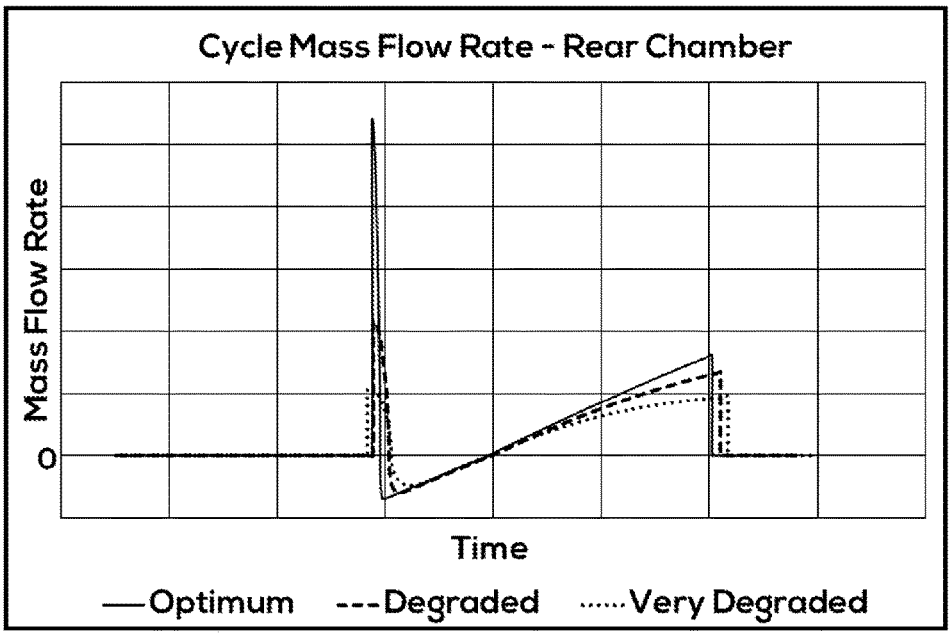

In a similar fashion, observing FIG. 9A and 9B, several conclusions can also be drawn:

The main effect of a reduction in the size of the rear chamber's (230) maximum feeding area is a degraded filling process of this chamber when the feeding of the rear chamber (230) with pressurized fluid starts during the rearward stroke. Also, the filling process slows down during the frontward stroke (after the reflow, which is identifiable by negative mass flow rate values), but at a less extent.

The filling process of the front chamber (240) stays almost unchanged despite a small increment in the piston's (60) reciprocating cycle period.

Finally, the elastic inward deformation of the cylinder (40) observed empirically in the realization of the pressurized fluid flow system described in U.S. Pat. No. 10,316,586 due to the permanent high pressure fluid acting on the thin bottom of the longitudinal supply channels (2) (main feed fluid passages (28) in U.S. Pat. No. 11,174,679) occurs precisely on the bottom of the longitudinal supply channels (2) between the rear discharge ports (43) and the front pressurized fluid exit ports (42) (in the longitudinal direction or the mechanism's axis direction). FIG. 6 shows a buffer undercut (49) that acts as a buffer for keeping the deformation far from the sliding surfaces (64,67) of the piston (60). This solution can be used to keep a thin bottom of the longitudinal supply channels (2) and make the cylinder (40) even thinner, considering that in practice this undercut should have only a few tenth of millimeters in depth. Should also be noted that this solution can't be used in the fluid flow systems described in U.S. Pat. No. 10,316,586 and U.S. Pat. No. 11,174,679 because it would create cross flows through the inner surface (47) of the cylinder (40).

The invention claimed is:

1. A pressurized fluid flow system for percussive mechanisms comprising:

a cylindrical outer casing having a rear end and a front end;

a driver sub mounted to the front end of said outer casing;

a rear sub affixed to said rear end of the outer casing for connecting the mechanism to a source of pressurized fluid;

a piston slidably and coaxially disposed inside said outer casing and capable of reciprocating due to changes in pressure of the pressurized fluid contained inside of a front chamber and a rear chamber located at opposites ends of the piston, the piston having a rear thrust surface, a front thrust surface, a front outer sliding surface and a rear outer sliding surface;

a cylinder coaxially disposed in between the outer casing and the piston, the cylinder having an inner and an outer surface;

a valve carrier disposed rear of the rear chamber, the valve carrier having a rear valve support surface;

a probe carrier disposed rear of the valve carrier, the probe carrier having a front valve support surface, one or more longitudinal fluid passageways, an inner valve sliding surface, one or more pressure transmitting radial passageways and one or more fluid supply through holes;

a valve mounted in a space created in between the valve carrier and the probe carrier, the valve able to slide longitudinally on the inner valve sliding surface of the probe carrier for moving between a front-located closed position and a rear-located open position, the valve further having a front support surface, a rear support surface, a front thrust surface, a rear thrust surface and a biasing thrust surface, the rear support surface and the rear thrust surface of the valve creating together with the inner valve sliding surface and the front valve support surface of the probe carrier a pressurized volume; and a drill bit slidably mounted on the driver sub, wherein the sliding movement of the drill bit is limited by a drill bit retainer mounted on the driver sub;

a pressurized fluid supply chamber defined by an annular recess on an external surface of the piston, the pressurized fluid supply chamber longitudinally limited at each end by the front and rear outer sliding surfaces respectively and being in permanent fluid communication with the source of pressurized fluid for supplying pressurized fluid to the front chamber;

a set of longitudinal supply channels created in between the outer surface of the cylinder and the inner surface of the outer casing for conveying pressurized fluid from the rear sub to the pressurized fluid supply chamber, the longitudinal supply channels being in permanent fluid communication with the source of pressurized fluid and filled with said fluid when the percussive mechanism is operative;

a set of longitudinal discharge channels created in between the outer surface of the cylinder and the inner surface of the outer casing for discharging pressurized fluid from the front chamber and the rear chamber, the longitudinal discharge channels being disposed longitudinally in parallel with respect to the longitudinal supply channels and being in permanent fluid communication with the outside of the percussive mechanism;

multiple pressurized fluid intake ports, multiple front pressurized fluid exit ports and rear and front sets of discharge ports provided in said cylinder respectively facing the sets of longitudinal supply and discharge channels, the pressurized fluid intake ports provided in said cylinder for connecting the longitudinal supply channels with the fluid supply through holes in the probe carrier and ultimately with the source of pressurized fluid, the front pressurized fluid exit ports provided in said cylinder for connecting the set of longitudinal supply channels of the cylinder with the pressurized fluid supply chamber and permanently filling it with pressurized fluid;

the front set of discharge ports provided in said cylinder for discharging the front chamber into the set of longitudinal discharge channels;

the rear set of discharge ports provided in said cylinder for discharging the rear chamber into the set of longitudinal discharge channels;

a front set of recesses provided on said cylinder and being disposed longitudinally in series with respect to the longitudinal supply channels for connecting the pressurized fluid supply chamber with the front chamber in cooperation with the front outer sliding surface of the piston when the rear chamber supplied with pressurized fluid in each piston's reciprocating cycle; and a set of longitudinal sensing channels created in between the outer surface of the cylinder and the inner surface of the outer casing for intermittently connecting, in cooperation with the rear outer sliding surface of the piston and a probe carrier's pressure transmitting radial passageways-connecting port and one or more rear chamber-connecting ports in each sensing channel, the rear chamber with the pressurized volume for allowing the opening of the valve when the rear chamber must be supplied with pressurized fluid in each piston's reciprocating cycle, the sensing channels being disposed longitudinally in series with respect to the longitudinal discharge channels.

2. The pressurized fluid flow system of claim 1, wherein the set of longitudinal supply channels are disposed in the outer surface of the cylinder.

3. The pressurized fluid flow system of claim 1, wherein the set of longitudinal supply channels are disposed in the inner surface of the outer casing.

4. The pressurized fluid flow system of claim 1, wherein the set of longitudinal discharge channels are disposed in the outer surface of the cylinder.

5. The pressurized fluid flow system of claim 1, wherein the set of longitudinal discharge channels are disposed in the inner surface of the outer casing.

6. The pressurized fluid flow system of claim 1, wherein the set of sensing channels are disposed in the outer surface of the cylinder.

7. The pressurized fluid flow system of claim 1, wherein the set of sensing channels are disposed in the inner surface of the outer casing.

8. The pressurized fluid flow system of claim 1, wherein the front set of recesses are extended through all holes in the cylinder.

9. The pressurized fluid flow system of claim 1, wherein the front set of recesses are formed in the inner surface of the cylinder.

10. The pressurized fluid flow system of claim 1, wherein the front set of recesses are formed in the outer surface of the cylinder and comprises one or more pressurized fluid supply chamber-connecting ports and one or more front chamber-connecting ports that fluidly connect the recesses with the cylinder's inner surface.

11. The pressurized fluid flow system of claim 1, wherein the cylinder has a buffer undercut in its inner surface.

* * * * *